US007571977B2

(12) United States Patent
Tonishi et al.

(10) Patent No.: US 7,571,977 B2
(45) Date of Patent: Aug. 11, 2009

(54) INK-JET RECORDING APPARATUS

(75) Inventors: Hisako Tonishi, Kariya (JP); Masashi Tsuda, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 343 days.

(21) Appl. No.: 11/678,566

(22) Filed: Feb. 23, 2007

(65) Prior Publication Data

US 2007/0200880 A1 Aug. 30, 2007

(30) Foreign Application Priority Data

Feb. 28, 2006 (JP) ..... 2006-052441

(51) Int. Cl.
*B41J 29/393* (2006.01)

(52) U.S. Cl. ..... 347/19; 347/85

(58) Field of Classification Search ..... 347/14, 347/19, 84–86

See application file for complete search history.

(56) References Cited

U.S. PATENT DOCUMENTS 5,471,234 A * 11/1995 Katano et al. ..... 347/171
7,247,198 B2 * 7/2007 Fujioka et al. ..... 106/31.6
2008/0238991 A1 * 10/2008 Morgan et al. ..... 347/33

FOREIGN PATENT DOCUMENTS

JP H09-0001819 A 1/1997
JP 2000-0141692 A 5/2000

* cited by examiner

*Primary Examiner*—Lamson D Nguyen
(74) *Attorney, Agent, or Firm*—Baker Botts L.L.P.

(57) ABSTRACT

An embodiment of the description relates to an ink-jet recording apparatus which includes an ink cartridge in which ink is stored in an ink chamber, and a mechanism that optically detects the amount of ink remaining in the ink chamber. The receding contact angle of the ink with respect to an inner wall surface of the ink chamber is about 20° or more.

19 Claims, 6 Drawing Sheets

INK-JET RECORDING APPARATUS

BACKGROUND OF THE INVENTION

This application claims the benefit of Japanese Patent Application No. 2006-052441, filed Feb. 28, 2006, which is incorporated herein by reference.

1. Field of the Invention

Embodiments of the present invention relate to an ink-jet recording apparatus that includes a mechanism that optically detects an amount of liquid remaining in a liquid chamber of a cartridge.

2. Description of the Related Art

An ink-jet recording apparatus includes an ink cartridge that supplies an ink to an ink-jet head. The ink cartridge may be attached to or detached from the ink-jet recording apparatus. When the ink chamber of the ink cartridge is empty, if the ink-jet head attempts to eject ink, not only will no ink be ejected, but also air may pass into the ink-jet head, for example as an air bubble. Therefore, it is useful to detect the amount of ink that remains in the ink chamber of the ink cartridge.

In one method of detecting remaining ink, the amount of ink used in printing is estimated, and the remaining amount of ink is determined. However, there may be error in this estimate. As a result, an ink cartridge may no longer be used even though some ink remains in the ink cartridge, which wastes the ink. For errors in the other direction, there may not be any ink remaining in the ink chamber and thus air may enter the ink-jet head.

To avoid this problem, a technology that uses the float has been suggested (for example, Japanese Patent Publication No. H09-001819 A). According to this technology, a non-light transmitting float that has a smaller specific gravity than an ink is disposed on the ink that is stored in an ink chamber of an ink cartridge. The float then floats on the ink and descends as the liquid surface descends with the use of ink. An optical path, which passes from a light emitting unit to a light receiving unit in an optical sensor disposed outside the ink, is interrupted by the float or other components of a float assembly when there is too little ink in the ink chamber. To use this technology, the light must be able to pass through the ink so that movement of the float into the light path is detectable. Accordingly, the ink in the ink chamber should allow high levels of light transmission. Typically to achieve this property the ink must contain a dye. Inks containing substantial amounts of pigment typically are not sufficiently light-transmissive to allow light from the light emitting unit to pass through the ink to the light receiving unit. As a result, the optical detector cannot distinguish the ink from the float.

Dye-based ink has a disadvantage in that it is likely to bleed on recording paper. In particular, when a character is recorded, the contour thereof easily becomes faint. To perform high quality ink-jet printing, a non-light transmitting pigment black ink is generally used as a black ink when the character is recorded in particular.

Pigment-based ink, in contrast, does not transmit light, making it difficult or impossible to distinguish from a float using an optical sensor. As a result, one cannot accurately detect the amount of pigment-based ink remaining in an ink chamber using a float and an optical sensor.

One may, however, detect pigment-based ink directly, without the need for a float, using an optical sensor because the ink itself interrupts the optical path. When highly accurate detection is performed by using this sensor, or when an optical sensor with low sensitivity is used to reduce cost, the ink chamber contains a narrow region to decrease the thickness of the ink layer between the light emitting unit and the light receiving unit of the optical sensor. However, ink in the narrow region adheres to the surface of the inner walls of the ink chamber by surface tension and rises. The causes the edges of the ink along the walls to be higher than the actual ink liquid surface. As a result, of the optical sensor detects an amount of ink remaining in the ink chamber that is larger than an actual amount. This problem occurs in not only ink containing the pigment but also ink containing the dye and ink-jet liquids (the fixing liquid, the colorless transparent ink, the shipping liquid and the like).

SUMMARY OF THE INVENTION

Embodiments of this invention provide an ink-jet recording apparatus that is capable of accurately detecting the remaining amount of ink-jet liquid (e.g., the remaining amount of ink) that is stored in a liquid chamber (e.g., an ink chamber) of a cartridge (e.g., an ink cartridge) using an optical detection mechanism without depending on whether the ink-jet liquid (e.g., ink) is light transmissive or not light transmissive.

Embodiments of the invention may reflect the relationship between the wettability of the ink-jet liquid with respect to the inner wall surfaces of the liquid chamber of the cartridge and highly accurate detection of the amount of ink-jet liquid remaining in the ink-jet recording apparatus. Dynamic contact angles between the ink-jet liquid and the inner wall surface reflect movement of the ink-jet liquid at the time of measurement. If a particular dynamic contact angle, the receding contact angle, is equal to or larger than a predetermined angle, measurement of the liquid remaining in the chamber may be accurate.

According to an embodiment of the invention, an ink-jet recording apparatus includes an ink cartridge in which ink is stored in an ink chamber and a mechanism that optically detects the amount of ink remaining in the ink chamber. In this apparatus, the receding contact angle of the ink with respect to an inner wall surface of the ink chamber is about 20° or more.

According to another embodiment of the invention, an ink-jet recording apparatus includes a cartridge in which an ink-jet liquid is stored in a liquid chamber, and a mechanism that optically detects the amount of ink-jet liquid remaining in the liquid chamber. In this apparatus, the receding contact angle of the ink-jet liquid with respect to an inner wall surface of the liquid chamber is about 20° or more.

According to yet another embodiment of the invention, a cartridge includes a liquid stored in a liquid chamber and a float assembly comprising at least one non-light transmissive component. In this cartridge, the receding contact angle of the liquid with respect to an inner wall surface of the liquid chamber is about 20° or more.

BRIEF DESCRIPTION OF THE DRAWINGS

Embodiments of the invention are described in detail with reference to the following drawings, in which like features are indicated by like numbers in which.

DESCRIPTION OF THE PREFERRED EMBODIMENTS

Figure 1A:
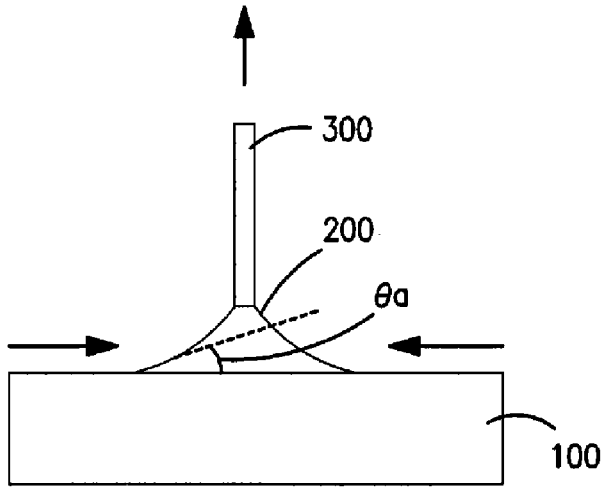
FIGS. 1A and 1B are schematic views illustrating a method of measuring a receding contact angle $\theta_a$ and an advancing contact angle $\theta_b$.
Figure 1B:
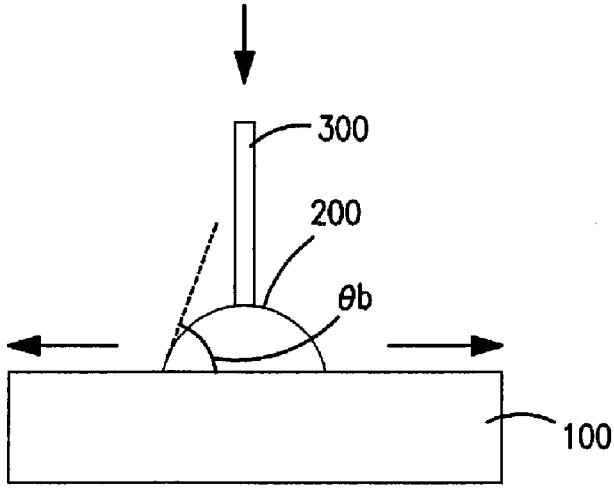

Embodiments of the invention relate to ink containing a coloring agent used in an ink-jet recording apparatus. The ink-jet recording apparatus may include an ink cartridge where ink is stored in an ink chamber, and a mechanism that optically detects the amount of ink remaining in the ink chamber. The receding contact angle of the ink with respect to an inner wall surface of the ink chamber may be about 20° or more. The receding contact angle may be defined as a contact angle formed when a droplet on any surface is constricted by suction from the surface at a predetermined speed, as shown in FIG. 1A. In contrast, the advancing contact angle is defined as a contact angle formed when a droplet on any surface is expanded by the surface at predetermined speed, as shown in FIG. 1B.

In the ink-jet recording apparatus according to an embodiment of the invention, if the receding contact angle is about 20° or more, even when the ink adheres on the inner wall surface of the ink chamber and rises above the ink liquid surface of the ink chamber, the ink is repelled and easily returns to the liquid surface level again. This allows accurate detection of the amount of ink remaining in the chamber. When the receding contact angle increases, wettability of the surface by the ink is lowered. Accordingly, in some embodiments the upper limit of the receding contact angle may be about 60°. When the receding contact angle exceeds about 60°, wettability may become so low that penetrability of the ink into recording paper is too low.

Further, in the ink-jet recording apparatus according to the embodiment of the invention, the advancing contact angle may be about 50° or more. Therefore, it is difficult for the ink to flow into an ink cartridge member due to vibration of the ink-jet recording apparatus, and the remaining amount of may be easily detected. Further, if the advancing contact angle increases, the wettability of the surface by the ink is lowered. Accordingly, in some embodiments the upper limit of the advancing contact angle is may be about 90°. When the advancing contact angle exceeds about 90°, wettability may become so low that penetrability of the ink into recording paper is too low.

To measure the receding contact angle or the advancing contact angle, in one possible method a predetermined amount of an ink droplet is loaded on a surface of a flat plate that is made of the same material as the inner wall surface of the ink chamber. The ink droplet is constricted or expanded using a contact angle meter (CA-X type) manufactured by Kyowa Interface Science Co., Ltd., as shown in FIGS. 1A and 1B. More specifically, as shown in FIG. 1B, in the contact angle meter, an ink droplet 200 (an initial amount of a droplet is 8.5 μL) is loaded on a surface of a flat plate (cartridge member 100) that is made of the same material as the inner wall surface of the ink chamber, and the ink droplet 200 is expanded for five seconds at a speed of 8.5 μL/sec with a syringe needle 300 stuck into the ink droplet 200. The contact angle $\theta_b$ that is measured during the expansion period is the advancing contact angle. As shown in FIG. 1A, after the advancing contact angle is measured, the ink droplet 200 that has been expanded is then constricted for five seconds at a speed of 8.5 μL/sec with a syringe needle 300 stuck into the ink droplet 200. The contact angle $\theta_a$ that is measured during the constriction period is the receding contact angle.

In embodiments of the invention, to achieve the desired receding contact angle and/or advancing contact angle, a particular material constituting the inner wall surface of the ink chamber may be selected, the surface roughness of the inner surface of the ink chamber may be adjusted, and/or a particular ink composition may be selected.

Examples of the material constituting the inner wall of the ink chamber include, but are not limited to, a thermoplastic resin such as polyethylene, polypropylene, polybutylene, polyethylene terephthalate, polystyrene, polycarbonate, polyamide, an acrylonitrile/styrene resin, an acrylonitrile/butadiene/styrene resin, a methacryl resin and an ionomer resin, which may be used for easy molding of the ink cartridge, and preferably, polyethylene and polypropylene. These materials may be light transmissive so as to allow use with an optical sensor.

Further, if the inner wall surface of the ink chamber is too rough, the ink adheres to the inner wall surface and remains on the inner wall surface. For this reason, the ten point height of roughness profile may be about 1.6 μm or less, and more specifically about 0.8 μm or less. In some embodiments, the whole inner wall surface of the ink chamber may satisfy the above ten point height of roughness profile. However, in other embodiments, only the partial inner wall surface in the light path of the optical detector may satisfy the above ten point height of roughness profile. Measurement of the ten point height of roughness profile may be carried out using the method as described in JIS B0601 (1994), for example, the method may use a Texture and Contour Measuring Instrument (Surf com 556A; manufactured by TOKYO SEIMITSU CO., LTD.).

The ink chamber may be made of the material constituting the inner wall surface of the ink chamber. In examples of this embodiment, the wall thickness of the ink chamber may be about 0.4 mm to about 0.6 mm because the wall thickness in order to bear a vacuum pressure upon introduction of the ink into the ink chamber. The portion of the ink chamber in the light path of the optical detector is typically light transmissive. In some embodiments it may be designed to prevent ink from flowing into or remaining in it as a result of capillary action. In a particular embodiment, the inner surface of the walls in this portion of the ink chamber may be about 2.5 mm to about 3.5 mm.

In an ink-jet recording apparatus according to an embodiment of this invention, the ink stored in the ink chamber of the ink cartridge may contain a coloring agent, a water-soluble organic solvent and water, such as those typically used in water-based ink for ink-jet recording.

The coloring agent is not particularly limited and includes, for example, a pigment and/or a dye. The pigment and the dye may be independently used; a combination of the pigments, of the dyes, or of the pigment and the dye may be used. The pigment is not limited although it it is typically dispersed in the water phase and includes, for example, an inorganic pigment and an organic pigment. The inorganic pigment is not limited and includes, for example, carbon black, titanium oxide, iron oxide and the like. The organic pigment is not limited, and includes, for example, an azo pigment such as azo lake, an insoluble azo pigment, a condensed azo pigment, chelate azo and the like; a polycyclic pigment such as a phthalocyanine pigment, a perylene pigment, a perinone pigment, an anthraquinone pigment, a quinacridone pigment, a dioxazine pigment, a thioindigo pigment, an isoindolinone pigment, a quinophthalone pigment and the like; a dye lake such as a basic dye type lake, an acidic dye type lake and the like; a nitro pigment; a nitroso pigment; an aniline black daylight fluorescent pigment and the like. Further, the pigment may be surface-treated with a surfactant, a polymer dispersant and the like, such as graft carbon.

Specifically, if the ink used is a black ink, examples of the coloring agent include carbon black such as furnace black, lamp black, acetylene black and channel black and the like. Carbon black may be made water-dispersible by a dispersant such as a surfactant and a polymer. Self-dispersible carbon black may be made water-dispersibile by chemical surface treatment to introduce a functional group such as a carboxylic group and/or a sulfonic group on the surface. Specific examples of carbon black include, but are not limited to, carbon black No. 25, No. 33, No. 40, No. 47, No. 52, No. 900, No. 2300, MCF-88, MA600, MA7, MA8 and MA100 (all of which are manufactured by Mitsubishi Chemical Corporation); Color Black FW1, FW2, FW2V, FW18, FW200, S150, S160 and S170, Printex 35, 150T, U, V, 140U, 140V, Special-Black 6, 5, 4A, 4 (all of which are manufactured by DEGUSSA); Raven 7000, 5750, 5250, 5000, 3500, 2000, 1500, 1250, 1200, 1190ULTRA-II, 1170 and 1255 (all of which are manufactured by Columbia); Black Pearls L, Regal 400R, 330R, 660R, Mogul L, Monarch 700, 800, 880, 900, 1000, 1100, 1300 and 1400, Valcan, CAB-O-JET 300 black and 200 black (all of which are manufactured by CABOT Corp.).

The dye used as the coloring agent in the ink is not limited and includes, for example, a water-soluble dye such as a direct dye, an acidic dye, a basic dye, a reactive dye and the like. Among these, dyes having an optimum property for ink, as well as other properties such as vividness, water solubility, stability, light fastness and the like, include, for example, C.I. direct black 17, 19, 32, 51, 71, 108, 146, 154 and 168; C.I. direct blue 6, 22, 25, 71, 86, 90, 106 and 199; C.I. direct red 1, 4, 17, 28, 83, 227; C.I. direct yellow 12, 24, 26, 86, 98, 132 and 142; C.I. direct orange 34, 39, 44, 46 and 60; C.I. direct violet 47 and 48; C.I. direct brown 109; C.I. direct green 59; C.I. acid black 2, 7, 24, 26, 31, 52, 63, 112 and 118; C.I. acid blue 9, 22, 40, 59, 93, 102, 104, 113, 117, 120, 167, 229 and 234; C.I. acid red 1, 6, 32, 37, 51, 52, 80, 85, 87, 92, 94, 115, 181, 256, 289, 315 and 317; C.I. acid yellow 11, 17, 23, 25, 29, 42, 61 and 71; C.I. acid orange 7 and 19; C.I. acid violet 49; C.I. basic black 2; C.I. basic blue 1, 3, 5, 7, 9, 24, 25, 26, 28 and 29; C.I. basic red 1, 2, 9, 12, 13, 14 and 37; C.I. basic violet 7, 14 and 27; C.I. food black 1 and 2; C.I. reactive red 180; and the like.

The amount of the coloring agent may be about 0.1 wt % to about 20 wt %, specifically about 0.3 wt % to 15 wt %, and more specifically about 0.5 wt % to about 10 wt %, with respect to the total amount of ink.

When a pigment other than the above self-dispersible pigment is used as a coloring agent, to the pigment may be dispersed using a known method involving an appropriate dispersing agent, water, a water-soluble organic solvent, and, if desired, other additives. The dispersion agent is not limited and includes, for example, a polymer dispersing agent a surfactant and the like. The polymer dispersing agent is not limited and includes, for example, a protein such as gelatin, albumin and the like; a natural rubber such as tragaganth gum and the like; a glycoside such as saponin and the like; a cellulose derivative such as methyl cellulose, carboxycellulose, hydroxy methyl cellulose and the like; a natural polymer such as a lignin sulfonic acid salt, shellac and the like; an anionic polymer such as poly acrylate, a salt of a styrene-acrylate copolymer, a salt of a vinyl naphthalene-acrylic acid copolymer, a salt of a stylene-maleic acid copolymer, a salt of a vinylnaphthalene-maleic acid copolymer, a sodium salt or phosphoric acid salt of a β-naphthalene sulfonic acid/formalin condensate; a nonionic polymer such as polyvinyl alcohol, polyvinyl pyrrolidone and polyethylene glycol; and the like. The surfactant is not limited and includes, for example, an anionic surfactant such as a salt of a higher alcohol sulfuric acid ester, a salt of a liquid fatty oil sulfuric acid ester, an alkyl aryl sulfonic acid salt and the like; a nonionic surfactant such as polyoxyethylene alkyl ether, polyoxy ethylene alkyl ester, sorbitan alkyl ester, polyoxy ethylene sorbitan alkyl ester and the like.

The dispersing agent may be used alone, or in a combination of two or more. The amount of the dispersing agent may be about 0.01 wt % to about 20 wt %, with respect to the total amount of ink.

In this invention, the dispersing machine used in dispersing the pigment used as a coloring agent of the ink is not limited. A general dispersing machine may be used. Examples of a general dispersing machine include a ball mill, a roll mill, a bead mill, a sand mill and the like. Among these, a high-speed bead mill may be used.

The water-soluble organic solvent in the ink may be used as a humectant or a penetrant. The purpose of the humectant is mainly to prevent the ink from precipitating a dry solid of from becoming dry in a nozzle front end of an ink-jet head. The purpose of the penetrant is mainly to control the penetrability on recording paper.

It may be preferable that the humectant have low volatility and highly solubility in the coloring agent. The humectant is not limited and includes, for example, polyols such as ethylene glycol, diethylene glycol, triethylene glycol, polyethylene glycol, propylene glycol, dipropylene glycol, tripropylene glycol, polypropylene glycol, 1,3-butanediol, 1,5-pentanediol, 1,6-hexanediol, glycerin, 1,2,6-hexanetriol, 1,2,4-butanetriol, 1,2,3-butanetriol, pentriol and the like; nitrogen-containing heterocyclic compounds such as N-methyl-2-pyrrolidone, N-hydroxyethyl-2-pyrrolidone, 2-pyrrolidone, 1,3-dimethylimidazolinone, ε-caprolactam and the like; amides such as formamide, N-methylformamide, N,N-dimethylformamide and the like; amines such as monoethanol amine, diethanol amine, triethanol amine, monoethylamine, diethyl amine, triethylamine and the like; sulfur-containing compounds such as dimethyl sulfoxide, sulfolane, thio diethanol and the like. The humectant may be used alone or in a combination of two or more.

The amount of the humectant may be about 1 wt % to about 50 wt %, and more specifically about 5 wt % to about 40 wt %, with respect to the total amount of ink. If the amount of the humectant is less than about 5 wt %, wetting may not be sufficient and precipitation of dry solids and dryness of ink may occur upon evaporation of moisture. If the amount of the humectant is more than about 40 wt %, the ink volatility excessively increases and ejection may not occur or dryness on recording media may be extremely delayed.

Examples of the penetrant include polyhydric alcohol alkyl ether and the like. The polyhydric alcohol alkyl ether is not limited and include, for example, diethylene glycol methyl ether, diethylene glycol butyl ether, diethylene glycol isobutyl ether, diethylene glycol dimethyl ether, diethylene glycol diethyl ether, diethylene glycol dibutyl ether, dipropylene glycol methyl ether, dipropylene glycol propyl ether, dipropylene glycol isopropyl ether, dipropylene glycol butyl ether, dipropylene glycol dimethyl ether, dipropylene glycol dipropyl ether, dipropylene glycol dibutyl ether, triethylene glycol methyl ether, triethylene glycol butyl ether, tripropylene glycol methyl ether, tripropylene glycol butyl ether, triethylene glycol dimethyl ether, triethylene glycol dibutyl ether, tripropylene glycol dimethyl ether, tripropylene glycol dibutyl ether and the like.

The amount of the penetrant may be about 0.05 wt % to about 15 wt %, and more specifically about 0.1 wt % to about 10 wt %, with respect to the total amount of ink.

The water used in the ink of the invention may be high-purity water such as ion exchanged water, distilled water, pure water, ultra pure water and the like.

Further, the ink may contain monohydric alcohols such as ethanol, isopropyl alcohol and the like, in order to control penetrability and dryness on recording paper.

A basic composition of the ink that is used in an embodiment of the invention is as above. The ink may also contain one or more of a pH modifier, a dye solubilizer, a mildew proofing agent, a preservative and the like. Further, when it is used in an ink-jet recording method in which ink is ejected by an action of thermal energy, for example, thermal physical values, such as specific heat, a thermal expansion coefficient, heat conductivity and the like, may be adjusted.

An ink-jet recording apparatus according to the embodiment of the invention includes the ink cartridge and a mechanism that optically detects the amount of ink remaining in the ink chamber, as described above. However, structures of other components, such as a transfer system, an ink-jet head, a printing control system and the like, are not limited. Hereinafter, a basic example of each of the ink-jet recording apparatus and the ink cartridge are described.

As one example of an ink cartridge that may be used in the ink-jet recording apparatus according to an embodiment of the invention, the cartridge may be attached to or detached from an ink-jet recording apparatus. The apparatus may include a light transmitting optical sensor having a light emitting unit and a light receiving unit that detect the amount of ink remaining in the cartridge ink chamber. The apparatus may also have a communicating tube that supplies the ink to the ink-jet head. The ink cartridge may include an ink chamber where the ink is stored and an ink supply passage that selectively guides the ink stored in the ink chamber to the outside and which may be inserted into the communicating tube. On an outer wall that is parallel to the direction of ink flow in the ink supply passage, the cartridge may include a first convex portion that extends along the direction of ink flow, and a second convex portion that extends along the direction of ink flow direction and has at least a portion that is not light transmissive. When the ink cartridge is mounted in the ink-jet recording apparatus, the ink supply passage is inserted into the communicating tube, and at least a portion of the first convex portion is located between the light emitting unit and the light receiving unit. When the ink cartridge is mounted in the ink-jet recording apparatus and when ink cartridge is detached from the ink-jet recording apparatus, at least a portion of the second convex portion passes between the light emitting unit and the light receiving unit.

Further, an ink-jet recording apparatus according to the embodiment of the invention may include an ink-jet head for ejecting the ink onto a recording medium and a cartridge mounting unit that mounts the ink cartridge so as to be freely attached to or detached from the cartridge mounting unit. The cartridge mounting unit may include a light transmitting optical sensor having a light emitting unit and a light receiving unit, and a communicating unit that supplies the ink stored in the ink chamber to the ink-jet head. When the ink cartridge is mounted in the cartridge mounting unit, after the second convex portion passes between the light emitting unit and the light receiving unit, at least a portion of the first convex portion is located between the light emitting unit and the light receiving unit, and at least a portion of the communicating tube is inserted into the ink supply passage. When the ink cartridge is detached from the ink cartridge mounting unit, after the first convex portion is separated from a space between the light emitting unit and the light receiving unit, and the second convex portion passes between the light emitting unit and the light receiving unit.

When the ink cartridge is mounted in the cartridge mounting unit of an ink-jet recording apparatus, the amount of ink remaining in the ink cartridge may detected by means of the light transmitting optical sensor by the first convex portion of the ink cartridge. Further, when the ink cartridge is mounted in the cartridge mounting unit, and when the ink cartridge is detached from the cartridge mounting unit, passage of the second convex portion through the light transmitting optical sensor is detected. Therefore, both the mounting state of the ink cartridge and the amount of ink remaining in the ink chamber of the ink cartridge may be detected using one light transmitting optical sensor.

In one embodiment, at least a portion of the first convex portion may be switched between being non-light transmissive and light transmissive depending on the amount of ink remaining in the ink chamber. In this way, the amount of ink remaining in the ink chamber may be accurately detected using a light transmitting optical sensor.

In may preferable in this type of embodiment for the width of each of the first and second convex portions to be smaller than the distance from the light emitting unit to the light receiving unit. In this way, the ink cartridge may be easily attached or detached. It may also be preferable for the width of the second convex portion to be smaller than the width of the first convex portion. Further, the second convex portion may be formed of a flat member. Furthermore, it may be preferable that the protrusion distance of the second convex portion be shorter than that of the first convex portion. In this way, the second convex portion may easily pass through the light transmitting type optical sensor and the ink cartridge may be more easily attached or detached.

An embodiment of the invention wherein an ink-jet recording apparatus is a color ink-jet recording apparatus that may eject inks of four colors is described below with respect to the accompanying drawings.

Figure 2:
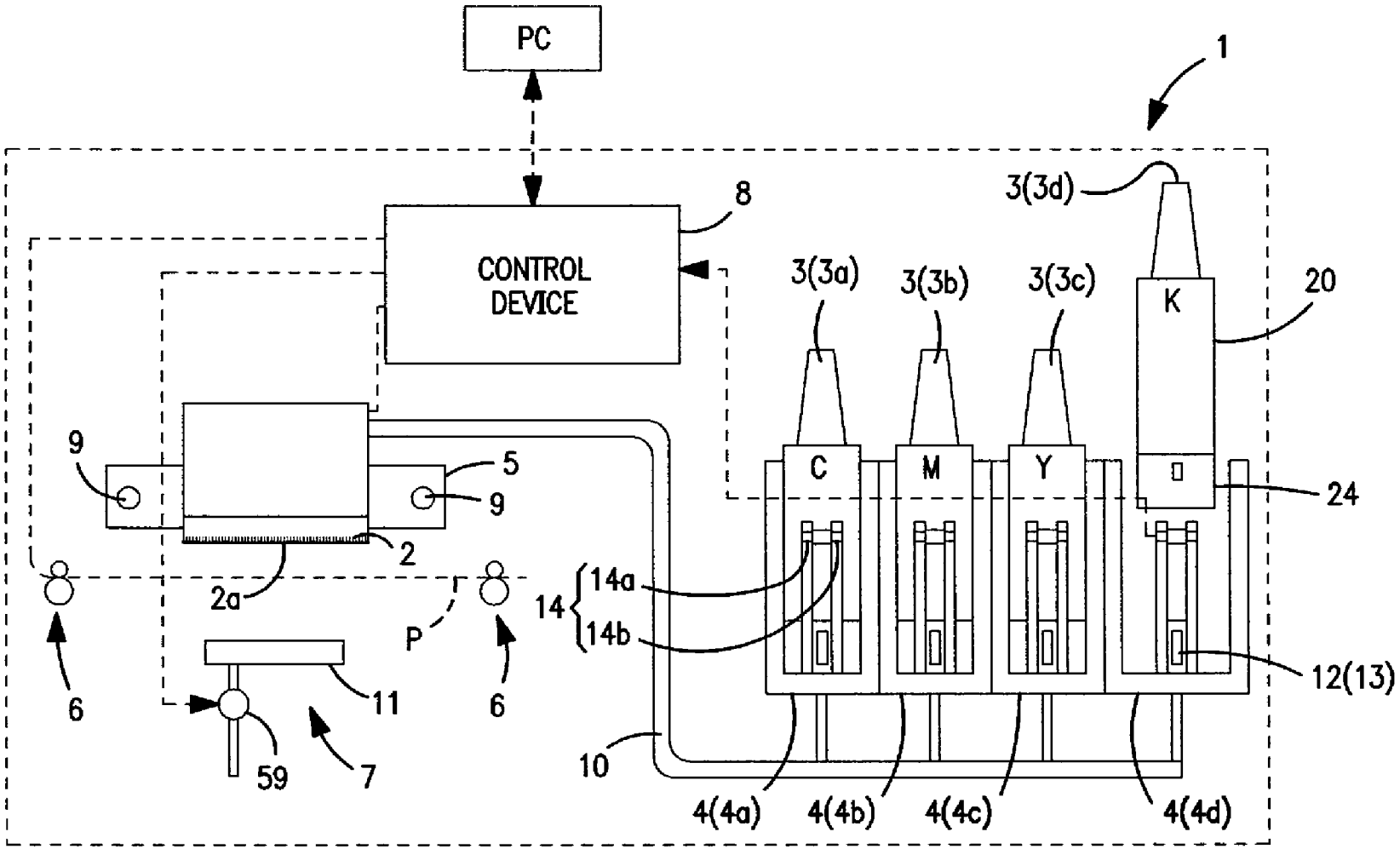
FIG. 2 is a schematic diagram illustrating an ink-jet recording apparatus according to an embodiment of the invention.

As shown in FIG. 2, a color ink-jet recording apparatus 1 includes: an ink-jet head 2 having nozzles 2*a* that eject inks of four colors including cyan (C), yellow (Y), magenta (M) and black (K) onto recording paper P; four holders 4 (4*a*, 4*b*, 4*c*, 4*d*) as cartridge mounting units where four ink cartridges 3 (3*a*, 3*b*, 3*c*, 3*d*) storing the respective inks of the four colors are mounted; a carriage 5 that makes the ink-jet head 2 move reciprocally along a guide 9 in a straight line in one direction (e.g., the direction vertical to the paper); a conveyance mechanism 6 that conveys the recording paper P in a direction (e.g., vertical) to a moving direction of the ink-jet head 2 and a direction parallel to an ink ejecting surface of the ink-jet head 2; a purge mechanism 7 that suctions air (e.g., an air bubble) in the ink-jet head 2 or removes the ink that has developed a high viscosity; and a control device 8 that controls the whole ink-jet recording apparatus 1.

In the ink-jet recording apparatus 1, while the ink-jet head 2 is reciprocally driven by the carriage 5 in a direction vertical to the paper of FIG. 2, the recording paper P is conveyed in a rightward-to-leftward direction of FIG. 2 by means of the conveyance mechanism 6. At the same time, the ink is supplied to the nozzles 2*a* of the ink-jet head 2 from the holder 4 where the ink cartridge 3 is mounted through a supply tube 10, and the ink is ejected from the nozzles 2*a* toward the recording paper P. As a result, an image is printed on the recording paper P.

The purge mechanism 7 may include a purge cap 11 that may move in a direction approaching the ink ejecting surface or spaced apart from the ink ejecting surface and that may be mounted in the ink-jet head 2 so as to cover the ink ejecting surface, and a suction pump 59 that suctions the ink from the nozzles 2*a*. In addition, when the ink-jet head 2 exists out of a printing range in which the ink-jet head 2 may print the ink on the recording paper P, air (e.g., air bubbles) introduced in the ink-jet head 2 or the ink from which moisture has evaporated and which has become too viscous may be suctioned from the nozzles 2*a* by the suction pump 59.

The four holders 4*a* to 4*d* may be disposed in one line, and the four ink cartridges 3*a* to 3*d* that store the cyan, the yellow, the magenta and the black inks may be respectively mounted in the four holders 4*a* to 4*d*. Black ink is typically used more than the three color inks. As a result, the capacity of black ink cartridge 3*d* may be larger than a capacity of each of the ink cartridges 3*a* to 3*c* for the color inks.

In a bottom portion of the holder 4, an ink supply tube 12 (e.g., communicating tube) and an air introducing tube 13 may be respectively provided at locations corresponding to an ink supply valve 21 and an air introducing valve 22 of the ink cartridge 3 to be described below. Further, in the holder 4, an optical sensor 14 (e.g., a light transmitting optical sensor) may also be provided which detects the amount of ink remaining in ink chamber 31 in the ink cartridge 3. The optical sensor 14 may have a light emitting unit 14*a* and a light receiving unit 14*b* that may be provided opposite to each other such that they interpose the ink cartridge 3 from both sides at locations having the same height. Further, the optical sensor 14 may detect whether light emitted from the light emitting unit 14*a* is shielded by means of a shutter mechanism 23 provided in the ink cartridge 3 to be described in detail below, and may outputs the detected result to a control device 8.

The ink cartridges 3*a* to 3*c* that store three kinds of color inks, respectively and the ink cartridge 3*d* that stores a black ink may have the same structure, and thus only one representative ink cartridge among them is described below.

Figure 3A:
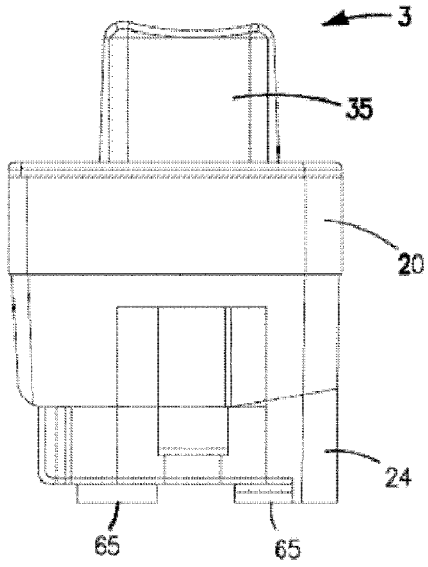
FIG. 3A is a plan view of an ink cartridge shown in FIG. 2.
Figure 3B:
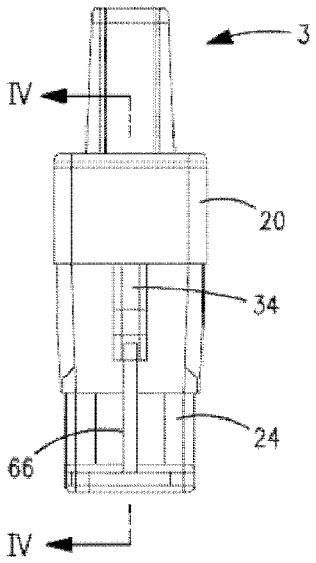
FIG. 3B is another plan view of an ink cartridge shown in FIG. 2.
Figure 3C:
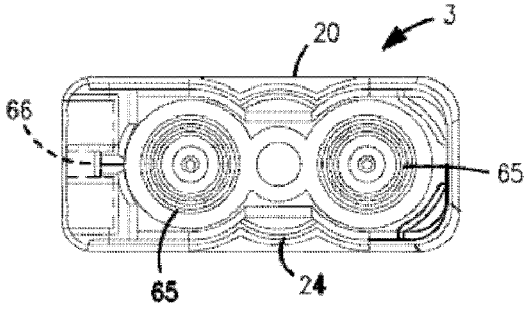
FIG. 3C is a bottom view of an ink cartridge shown in FIG. 2.
Figure 4:
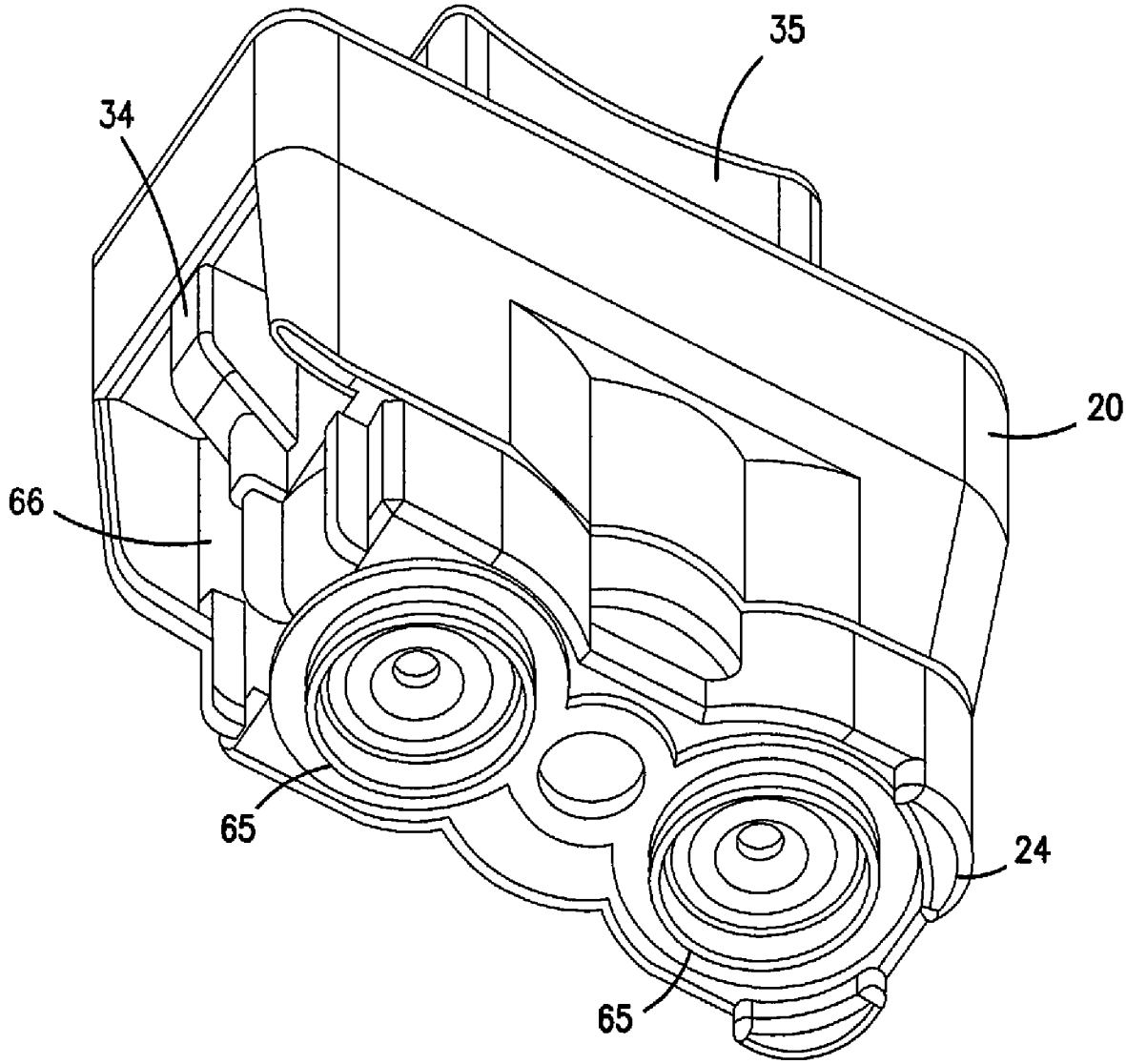
FIG. 4 is a perspective view of an ink cartridge shown in FIG. 2, when viewed from a lower side.
Figure 5:
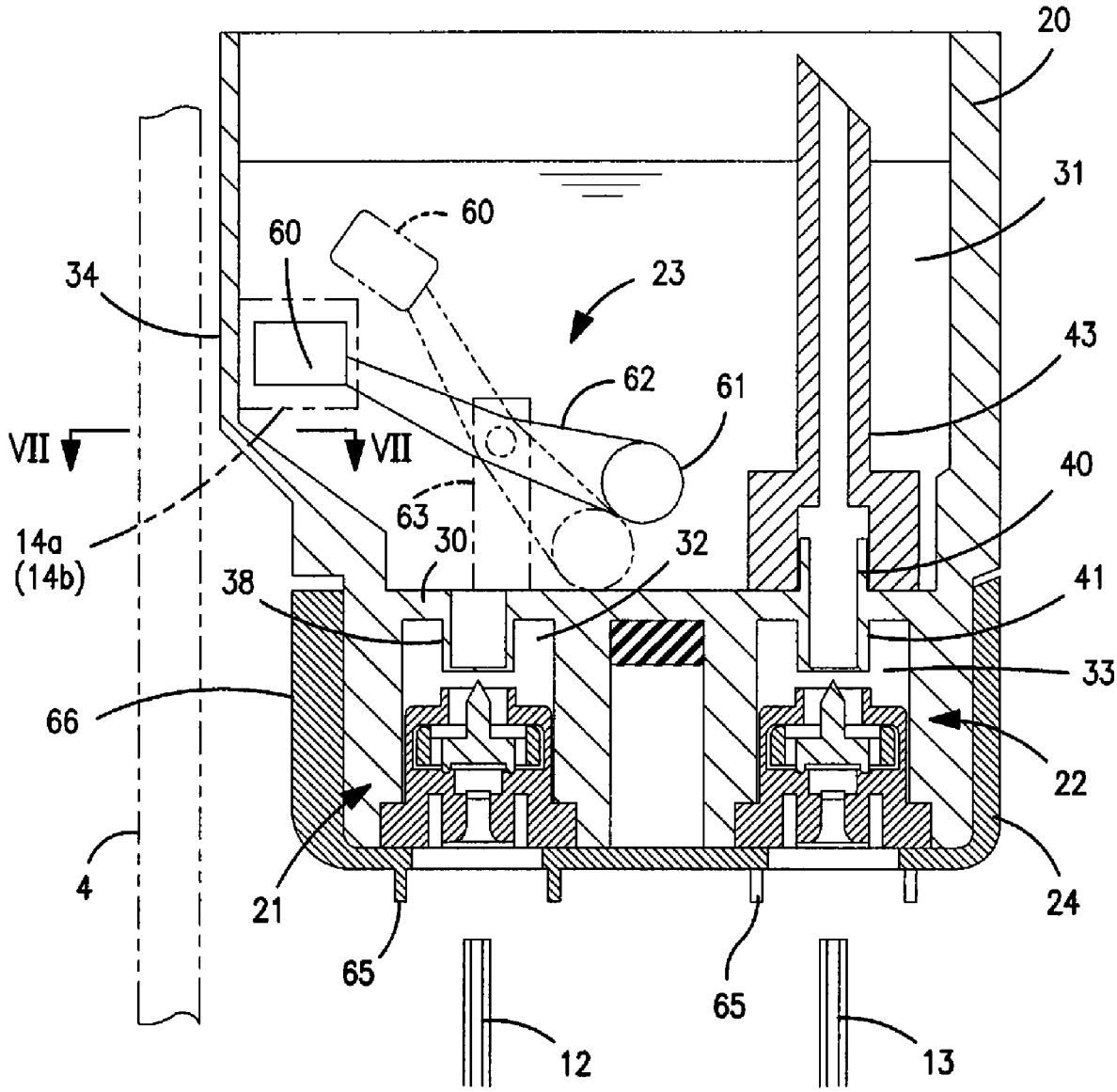
FIG. 5 is a cross-sectional view taken along the line IV-IV of FIG. 3B.

As shown in FIGS. 3 to 5, the ink cartridge 3 may include a cartridge main body 20 that stores the ink, an ink supply valve 21 that may open and close an ink supply passage that supplies the ink in the cartridge main body 20 to the ink-jet head 2, an air introducing valve 22 that may open and close an air introducing passage that introduces the air into the cartridge main body 20 from the outside, a shutter mechanism 23 that shields light emitted from the light emitting unit 14*a* of the optical sensor 14 to detect a residual amount of ink, and a cap 24 that covers a lower end of the carriage main body 20.

The cartridge main body 20 may formed of a synthesic resin that has a light transmitting property. As shown in FIG. 5, a partition wall 30 that extends in a horizontal direction may be integrally formed in the cartridge main body 20. Using the partition wall 30, an inner space of the cartridge main body 20 maybe partitioned into an ink chamber 31 on an upstream, and two valve accommodating chambers 32 and 33 on a downstream. The respective color inks may be filled in the ink chamber 31, and the ink supply valve 21 and the air introducing valve 22 may be accommodated in the two value accommodating chambers 32 and 33, respectively. At this time, an ink supply passage may be configured in the valve accommodating chamber 32 such that it guides the ink filled into the ink chamber 31 to the outside. As shown in FIGS. 3B and 3C, at a central location of the side wall (outer wall parallel to the ink flowing direction) of the ink chamber 31 in a height wise direction, a protruding portion 34 (first convex portion) may be formed which protrudes to the outside and extends along a downward direction (ink flowing direction). In the space in the protruding portion 34, a light shielding plate 60 (having a non-light transmitting property) of the shutter mechanism 23 to be described below may be disposed. In addition, in a state in which the ink cartridge 3 is mounted in the holder 4, the protruding portion 34 may be interposed between the light emitting unit 14*a* and the light receiving unit 14*b* of the optical sensor 14. At this time, because the width of the protruding portion 34 is shorter than the distance between the light emitting unit 14*a* and the light receiving unit 14*b*, a predetermined clearance may be maintained between the light emitting unit 14*a* and the light receiving unit 14*b*, and the protruding portion 34. A cover member 35 may be attached to an upper end of the cartridge main body 20 by welding, and the ink chamber 31 of the cartridge main body 20 may be closed by the cover member 35.

As shown in FIG. 5, when the ink cartridge 3 is mounted in the holder 4, the ink in the ink chamber 31 may flow into the valve accommodating chamber 32 through a communicating path in a cylindrical portion 38, and the ink may be supplied from the ink supply tube 12 to the ink-jet recording apparatus 1 side. At this time, the valve accommodating chamber 32 may function as the ink supply passage, and an ink flow may occur in a downward direction from the ink chamber 31 side.

Further, when the ink cartridge 3 is mounted in the holder 4, external air may be introduced into the valve accommodating chamber 33 from the air introducing tube 13, and air may be introduced into an upper portion of the ink chamber 31 through an inner passage of the cylindrical portions 40 and 41, and the cylindrical tube 43.

As shown in FIG. 5, a shutter mechanism 23 may be provided in a lower space of the ink chamber 31. The shutter mechanism 23 may include a float assembly including light shielding plate 60 that does not transmit light, a float which has a hollow 61, a connecting member 62 that connects the light shielding plate 60 and the float 61, and a supporting platform 63 that may be provided on the partition wall 30 and pivots the connecting member 62. The light shielding plate 60 and the float 61 may be respectively provided at both ends of the connecting member 62, and the connecting member 62 may be disposed such that it can rock in a vertical surface parallel to the paper of FIG. 5 on the basis of a pivoting point of the supporting platform 63.

The light shielding plate 60 may be a flat member that is parallel to the vertical surface and has a predetermined area. When the ink cartridge 3 is mounted in the holder 4, the light emitting unit 14*a* and the light receiving unit 14*b* of the optical sensor 14 that may be provided in the holder 4 may be located at the same height as the protruding portion 34 that may be formed on the side wall of the cartridge main body 20. In addition, when the light shielding plate 60 is located in a space in the protruding portion 34, the light shielding plate 60 may shields light that has been transmitted through the walls of cartridge main body 20 and ink in the ink chamber 31 from the light emitting unit 14*a* of the optical sensor 14. The float 61 may be an air-filled cylindrical member and the specific gravity of the float 61 may be less than that of the ink in the ink chamber 31.

Accordingly, when a large amount of ink remains in the ink chamber 31 and the float 61 provided in one end of the connecting member 62 is located in the ink, the float 61 floats by buoyancy, and the light shielding plate 60 that is provided in the other end of the connecting member 62 is located at a position (position indicated by a solid line of FIG. 5) that shields light from the light emitting unit 14*a* in the protruding portion 34. However, if the amount of ink remaining in the ink chamber 31 is decreased and a portion of the float 61 is exposed from a liquid surface of the ink, buoyancy of the float 61 is decreased, and thus the float 61 falls. The light shielding plate 60 moves to a location closer to the upper side than the inner portion of the protruding portion 34. In such a location the light shielding plate 60 does not shield the light directly from the light emitting unit 14*a* (location shown by a chain line of FIG. 5), the light emitted from the light emitting unit 14*a* transmits through the protruding portion 34 in a linear optical path, and is then directly received by the light receiving unit 14*b*. In this way, optical sensor 14 may detect when the amount of ink remaining in the ink chamber 31 is small.

Different from the cartridge main body 20, the cap 24 may be formed of a non-light transmitting material that does not transmit light. As shown in FIGS. 3 to 5, the cap 24 may be fixed on the cartridge main body 20 by ultrasonic welding or the like such that the cap 24 covers the lower end of the cartridge main body 20. In the bottom portion of the cap 24, at the locations that correspond to the ink supply valve 21 and the air introducing valve 22, two circular protrusions 65 that protrude downward may be respectively provided. When the ink cartridge 3 is put on a desk on the like, it becomes difficult for the ink near an inlet of the ink supply valve 21 or the air introducing valve 22 to adhere on a surface of the desk or the like.

Figure 6:
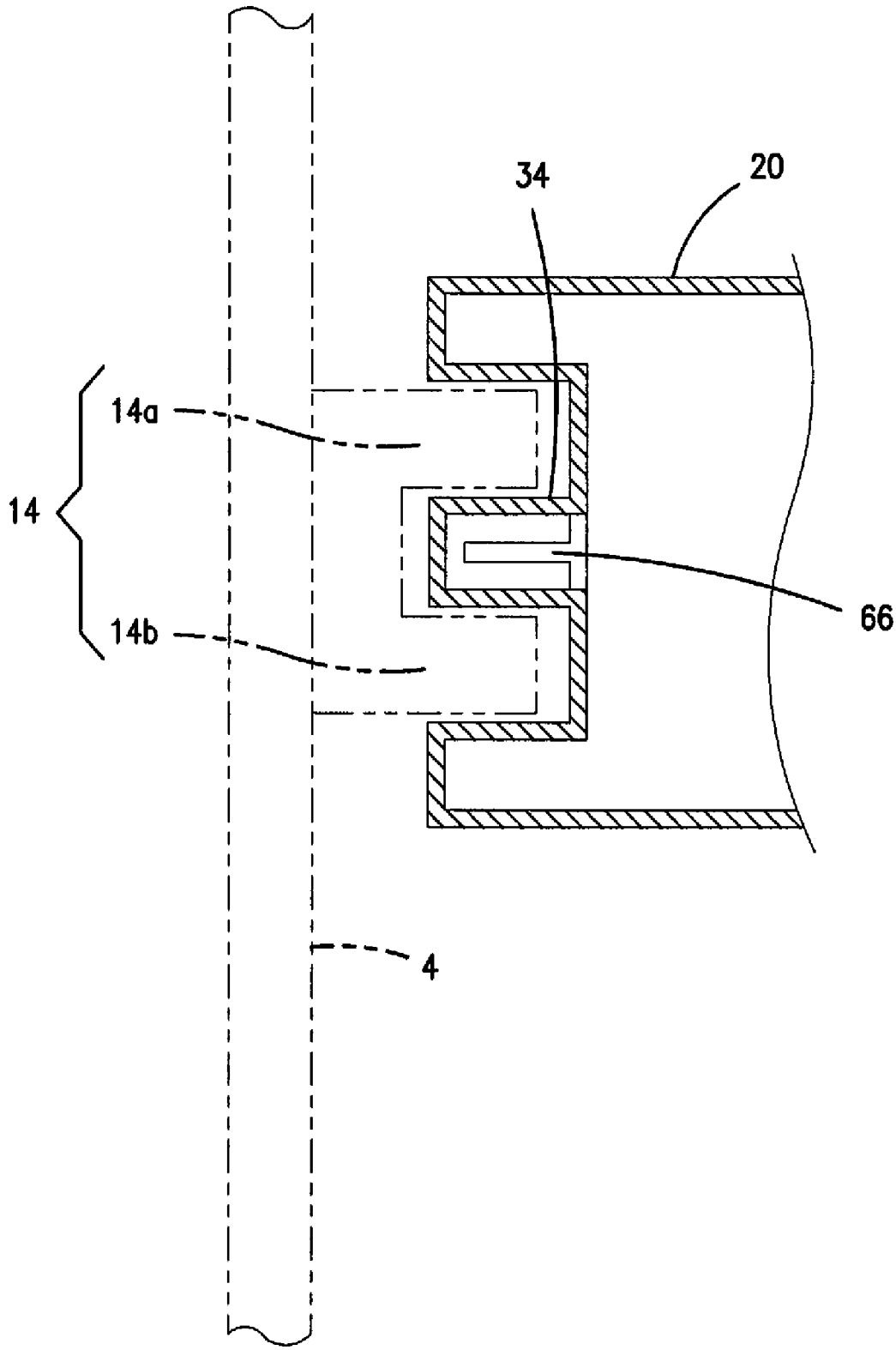
FIG. 6 is a cross-sectional view taken along the line VII-VII of FIG. 5.

In the sidewall (outer wall parallel to the direction of ink flow) of the cap 24 at the same side as the protruding portion 34, a rib-shaped convex portion 66 (second convex portion) may be formed which extends in an upward-downward direction (ink flowing direction). As shown in FIGS. 3B and 5, the convex portion 66 and the light shielding plate 60 in the protruding portion 34 of the cartridge main body 20 may be disposed at a location spaced by a predetermined distance along the vertical direction (direction of ink flow), and the convex portion 66 may be disposed on a lower side than the light shielding plate 60 (the side of the direction of ink flow). Accordingly, when the ink cartridge 3 is mounted in the holder 4, the convex portion 66 is located lower than the light emitting unit 14*a* and the light receiving unit 14*b* of the optical sensor 14. As shown in FIG. 6, the convex portion 66 may be disposed between the light emitting unit 14*a* and the light receiving unit 14*b* of the optical sensor 14 in plan view, that is, when the ink cartridge 3 is viewed from the upper side. Further, the width of the convex portion 66 may be smaller than that of the protruding portion 34, and the protruding distance of the convex portion 66 may be shorter than the protruding distance of the protruding portion 34.

Only when the ink cartridge 3 is mounted in the holder 4 or the ink cartridge 3 is detached from the holder 4, the convex portion 66 passes between the light emitting unit 14*a* and the light receiving unit 14*b*, and intermittently shields light emitted from the light emitting unit 14*a* of the optical sensor 14 to be detected. When ink cartridge 3 is mounted in the holder 4, the convex portion 66 is not detected by the optical sensor 14, and the light shielding plate 60 that is disposed in the ink chamber 31 may be only detected by optical sensor 14. Because the convex portion 66 maybe detected by the optical 14 only when the ink cartridge 3 is attached or detached, the control device 8 described below may detect whether the ink cartridge 3 is mounted or not. Further, the ink cartridge 3 may be attached or detached only in one direction, so that the convex portion 66 may be detected by the optical sensor 14. Therefore, it may not be necessary to perform a complicated operation to detect the convex portion 66 by the optical sensor 14.

Embodiments of the invention have been described above. However, the invention is not limited thereto, and various design modifications may be made without departing from the scope and spirit of the invention. For example, in one above embodiment, the connecting member 62 moves based on amount of ink remaining in the ink chamber, such that the location of the light shielding plate 60 is changed. However, the light shielding plate may be directly attached to the float that is disposed on the ink, such that the location of the light shielding plate may be changed.

The above-described embodiments relate to an ink containing a coloring agent. When other ink-jet liquids, for example, the fixing liquid, the colorless transparent ink, the shipping liquid and the like are used, in the above embodiment described for use with ink, the ink may be replaced by the ink-jet liquid (or simply, liquid), the ink cartridge may be replaced by a cartridge, the ink chamber may be replaced by a liquid chamber, and the amount of ink remaining may be replaced by an amount of liquid remaining.

EXAMPLES

The following examples are provided only to illustrate certain embodiments of the description and are not intended to embody the total scope of the invention or any embodiment thereof. Variations of the exemplary embodiments below are intended to be included within the scope of the invention.

Examples 1 to 4 and Comparative Examples 1 to 5

1) Preparation of Ink

Ink composition components which are summarized in Table 1 were sufficiently stirred and mixed. The mixtures were then filtered using a 1.0 μm membrane filter to obtain inks 1 to 4.

TABLE 1

| | | Ink 1 | Ink 2 | Ink 3 | Ink 4 |
|---|---|---|---|---|---|
| Ink composition (wt %) | CAB-O-JET ® 300 *1 | 33.3 | 33.3 | 33.3 | 33.3 |
| | Disperbyk 190 *2 | — | 0.2 | 2.0 | — |
| | glycerin | 25.0 | 21.0 | 21.0 | 25.0 |
| | dipropylene glycol propyl ether | 1.0 | 1.0 | 1.0 | 1.0 |
| | Surfynol ® 465 *3 | 0.1 | — | — | 0.3 |
| | Sunnol ® LMT-1430 *4 | — | 0.1 | 0.1 | — |
| | Pure water | 40.6 | 44.4 | 42.6 | 40.4 |

*1: self-dispersible carbon black dispersion; pigment concentration = 15 wt % (residual portion = pure water); manufactured by CABOT CORPORATION.
*2: pigment affinity block copolymer; BYK-Chemie Japan KK
*3: surfactant; Air Products and Chemicals, Inc.
*4: alkylbenzene sulfuric ester salt; Lion Corporation 2) Evaluation Ink cartridges Nos. 1 to 5 were prepared. A flat plate corresponding to each of ink cartridges 1 to 5 was made of the same material as the inner wall surface of the portion of the ink chamber where optical detection would occur. A ten point height of roughness profile measurement at the optical detection portion was made. A measurement of the advancing contact angle and receding contact angle was also made, when inks 1 to 4 were combined with the ink cartridges Nos. 1 to 5. Finally, the amount of ink remaining in these cartridges was determined using an optical sensor and compared to the actual amount of ink remaining. Combinations tested and test results are summarized in Table 2.

(a) Ten Point Height of Roughness Profile Measurement

The ten point height of roughness profile of the inner wall surfaces of the optical detection portions of the ink chambers were measured by using a Textuer and Contour Measuring Instrument (Surfcom 556A; manufactured by TOKYO SEIMITSU CO., LTD.), as disclosed in JIS B0601 (1994).

(b) Advancing Contact Angle Measurement and Receding Contact Angle Measurement

Ink droplets of 8.5 μL were loaded on a surface of a flat plate that was made of the same material as a material constituting inner wall surfaces of optical detection portions of the ink chambers. The ink droplet was expanded for five seconds at a speed of 8.5 μL/sec with a syringe needle stuck in the droplet. Between 2.0 to 2.9 seconds after the ink expansion starts, contact angles of ten points were measured every 0.1 seconds. An average value was calculated to determine the advancing contact angle. After the advancing contact angle was measured, the ink droplet was constricted at a speed of 8.5 μL/sec with a syringe needle stuck in the droplet. Between 2.0 to 2.9 seconds after the ink constriction starts, contact angles of ten points were measured every 0.1 seconds. An average value was calculated to determine the receding contact angle. The receding contact angle measurement and the advancing contact angle measurement were performed by using a contact angle meter (CA-X type) manufactured by Kyowa Interface Science Co., Ltd.

(c) Remaining Amount of Ink Detecting Test

In the combinations summarized in Table 2, inks 1 to 4 are filled in the ink cartridges Nos. 1 to 5. The ink cartridges filled with the inks were mounted in a digital multifunction machine with an ink-jet recording apparatus (DCP-110C, manufactured by Brother Industries, Ltd.) and printing was continuously performed. The cartridge was constructed to detect when 3.0±0.6 g of ink was remaining. When the optical sensor indicated that this amount of ink remained, the actual amount of ink remaining in the cartridge was measured. If the actual amount of ink remaining in the cartridge was 3.0±0.6 g, then the detection was accurate.

(d) Evaluation of Remaining Amount of Ink Detecting Test

In Table 2, G indicates that the amount of ink remaining in the ink chamber when the optical sensor indicated 3.0±0.6 g was remaining. For the sensor to be considered accurate, the actual amount of ink remaining was not less than 2.4 g and not more than 3.6 g.

In Table 2, NG indicates that the amount of ink remaining in the ink chamber when the optical sensor indicated 3.0±0.6 g was remaining. For the sensor to be considered accurate, the actual amount of ink remaining was less than 2.4 g or more than 3.6 g.

TABLE 2

| | | Example | | | | Comparative example | | | | |
|---|---|---|---|---|---|---|---|---|---|---|
| | | 1 | 2 | 3 | 4 | 1 | 2 | 3 | 4 | 5 |
| Ink Cartridge | | No. 1 | No. 2 | No. 3 | No. 2 | No. 2 | No. 2 | No. 4 | No. 4 | No. 5 |
| Ink Cartridge material | | Polyethylene | polyethylene | polypropylene | polyethylene | polyethylene | polyethylene | polyethylene | polyethylene | polyethylene |
| Ten Point Height of Roughness Profile [μm] | | 0.8 | 1.6 | 1.6 | 1.6 | 1.6 | 1.6 | 3.2 | 3.2 | 6.3 |
| Ink | | Ink 1 | Ink 1 | Ink 1 | Ink 2 | Ink 3 | Ink 4 | Ink 1 | Ink 2 | Ink 1 |
| Contact Angle | Advancing Contact Angle [°] | 57 | 53 | 54 | 53 | 48 | 47 | 48 | 46 | 45 |
| | Receding Contact Angle [°] | 28 | 25 | 25 | 23 | 16 | 13 | 17 | 15 | 13 |
| Remaining Amount of Ink Detecting Test | | G | G | G | G | NG | NG | NG | NG | NG |
| Remaining Amount of Ink [g] | | 2.8 | 3.0 | 3.0 | 3.3 | 4.0 | 4.4 | 3.8 | 4.1 | 4.4 |

As Table 2 shows, in ink-jet recording apparatuses of Examples 1 to 4, the amount of ink remaining in the ink chamber was correctly detected. Examples 1 to 4 include ink cartridges having inner wall surfaces of optical detection portions of ink chambers that are made of material with which a receding contact angle with respect to the ink is not less than 20° and an advancing contact angle is not less than 50°. In contrast, in ink-jet recording apparatuses of Comparative Examples 1 to 5, the amount of ink remaining in the ink chamber was not correctly detected. Comparative Examples 1 to 5 include ink cartridges having inner wall surfaces of optical detection portions of ink chambers that are made of the material with which a receding contact angle with respect to the ink is less than 20° and an advancing contact angle is less than 50°.

Although embodiments of the present invention have been described in detail herein, the scope of the invention is not limited thereto. It will be appreciated by those of ordinary skill in the relevant art that various modifications may be made without departing from the scope of the invention. Accordingly, the embodiments disclosed herein are exemplary. It is to be understood that the scope of the invention is not to be limited thereby, but is to be determined by the claims which follow.

What is claimed is:

1. An ink-jet recording apparatus comprising:

an ink cartridge in which ink is stored in an ink chamber; and a mechanism that optically detects an amount of ink remaining in the ink chamber, wherein a receding contact angle of the ink with respect to an inner wall surface of the ink chamber is about 20° or more.

2. The ink-jet recording apparatus according to claim 1, wherein an advancing contact angle of the ink with respect to the inner wall surface of the ink chamber is about 50° or more.

3. The ink-jet recording apparatus according to claim 1, wherein a ten point height of roughness profile of at least a portion of the inner wall surface of the ink chamber is about 1.6 μm or less.

4. The ink-jet recording apparatus according to claim 3, wherein at least a portion of the inner wall surface of the ink chamber is detected by the mechanism that optically detects the amount of ink remaining in the ink chamber.

5. The ink-jet recording apparatus according to claim 1, wherein the ink cartridge further comprises a float assembly comprising at least one non-light transmissive component.

6. The ink-jet recording apparatus according to claim 5, wherein the float assembly comprises a float and a light shielding plate.

7. The ink-jet recording apparatus according to claim 5, wherein the mechanism that optically detects the amount of ink remaining in the ink chamber optically detects a component of the float assembly.

8. An ink-jet recording apparatus comprising:

a cartridge in which an ink-jet liquid is stored in a liquid chamber; and a mechanism that optically detects an amount of ink-jet liquid remaining in the liquid chamber, wherein a receding contact angle of the ink-jet liquid with respect to an inner wall surface of the liquid chamber is about 20° or more.

9. The ink-jet recording apparatus according to claim 8, wherein an advancing contact angle of the ink-jet liquid with respect to the inner wall surface of the liquid chamber is about 50° or more.

10. The ink-jet recording apparatus according to claim 8, wherein a ten point height of roughness profile of at least a portion of the inner wall surface of the liquid chamber is about 1.6 μm or less.

11. The ink-jet recording apparatus according to claim 10, wherein at least a portion of the inner wall surface of the liquid chamber is detected by the mechanism that optically detects the amount of liquid remaining in the liquid chamber.

12. The ink-jet recording apparatus according to claim 8, wherein the cartridge further comprises a float assembly comprising at least one non-light transmissive component.

13. The ink-jet recording apparatus according to claim 12, wherein the float assembly comprises a float and a light shielding plate.

14. The ink-jet recording apparatus according to claim 12, wherein the mechanism that optically detects the amount of liquid remaining in the liquid chamber optically detects a component of the float assembly.

15. An cartridge comprising:

a liquid stored in a liquid chamber, wherein a receding contact angle of the liquid with respect to an inner wall surface of the liquid chamber is about 20° or more; and a float assembly comprising at least one non-light transmissive component.

16. The cartridge according to claim 15, wherein an advancing contact angle of the liquid with respect to the inner wall surface of the liquid chamber is about 50° or more.

17. The cartridge according to claim 15, wherein a ten point height of roughness profile of at least a portion of the inner wall surface of the liquid chamber is about 1.6 μm or less.

18. The cartridge according to claim 15, wherein the float assembly comprises a float and a light shielding plate.

19. The cartridge according to claim 15, wherein the liquid stored in the liquid chamber comprises ink stored in an ink chamber.

* * * * *